US007949264B2

(12) United States Patent
Mae et al.

(10) Patent No.: US 7,949,264 B2
(45) Date of Patent: May 24, 2011

(54) IMAGE FORMING APPARATUS AND METHOD

(75) Inventors: Hideo Mae, Nagoya (JP); Kazuo Okunishi, Okazaki (JP); Masaharu Hashizume, Okazaki (JP); Tatsutoshi Yamada, Toyokawa (JP); Masayuki Inoue, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 364 days.

(21) Appl. No.: 12/173,359

(22) Filed: Jul. 15, 2008

(65) Prior Publication Data

US 2009/0022503 A1 Jan. 22, 2009

(30) Foreign Application Priority Data

Jul. 17, 2007 (JP) ..... 2007-185968

(51) Int. Cl.
*G03G 15/00* (2006.01)
*G03G 15/08* (2006.01)

(52) U.S. Cl. ..... 399/12; 399/58

(58) Field of Classification Search ..... 399/12, 399/13, 9, 53, 58
See application file for complete search history.

(56) References Cited

U.S. PATENT DOCUMENTS 6,819,900 B2 * 11/2004 Itoh
7,003,234 B2 * 2/2006 Itoh

FOREIGN PATENT DOCUMENTS

| | | |
|---|---|---|
| JP | 05-181364 | 7/1993 |
| JP | 10-020670 | 1/1998 |
| JP | 11-237785 A | 8/1999 |
| JP | 2001-305845 A | 11/2001 |

OTHER PUBLICATIONS

Notice of Preliminary Rejection in JP 2007-185968 dated Jun. 23, 2009, and an English Translation thereof.

* cited by examiner

*Primary Examiner* — Susan S Lee
(74) *Attorney, Agent, or Firm* — Buchanan Ingersoll & Rooney PC

(57) ABSTRACT

When an image forming apparatus is disabled due to a cause rather than the detection of the toner empty condition, it is determined whether a recovery operation is a first recovery operation or a second recovery operation. The first recovery operation is associated with a mounting/dismounting of the toner cartridge performed from when the image forming apparatus is disabled until when the recovery operation begins. The second recovery operation is not associated with the mounting/dismounting. A toner supply control controls the toner supply operation when the recovery operation is performed on condition that the empty memory memorizes that the toner empty detector detects the empty condition. When the recovery operation is the first recovery operation, the toner supply control allows the toner to be supplied into the developer housing. While, when the recovery operation is the second recovery operation, the toner supply control prohibits the toner from being supplied into developer housing.

9 Claims, 9 Drawing Sheets

IMAGE FORMING APPARATUS AND METHOD

FIELD OF THE INVENTION

The present invention relates to an electrophotographic image forming apparatus and image forming method and, more particularly, to copy machine, a printing machine, a facsimile machine, and a multifunction peripheral including functions of those machines in combination, and a method for forming an image using the apparatuses.

BACKGROUND OF THE INVENTION

An image forming apparatus equipped with a detachable toner cartridge has been proposed, in which an image forming operation is prohibited when the toner in the toner cartridge is consumed. Hereinafter, this condition is referred to as "toner empty" or "toner empty condition".

The toner empty is memorized in a memory of the apparatus. To recover from the toner empty condition, a user opens a front door of the apparatus to exchange the toner cartridge and then closes the front door. This allows a toner supply device in the apparatus starts supplying the toner from the new toner cartridge into the associated developing device. This technique is disclosed in JP 11-237785 A, for example. When the toner supply operation is properly performed and thereby a required amount of toner is accommodated in the developing device, the image forming operation can be restarted.

There may be case in which the toner empty is detected and then a power saving condition is started or a power supply is turned off while leaving the empty cartridge in the apparatus. In this instance, the toner supply operation is supposed to be done after a recovery operation is completed, i.e., the power saving condition is cleared or the power supply is turned on. Meanwhile, if the toner cartridge exchange has been completed before the recovery operation, the toner supply is properly performed. Otherwise, no toner is supplied from the toner cartridge to the developing device after the subsequent recovery operation. Also, if this condition is detected repeatedly, it can erroneously be determined that the toner supply device is inoperative, which prohibits the start of the image forming operation and/or increases waiting time before the initiation of the image forming operation.

SUMMARY OF THE INVENTION

Thus, it is an object of the present invention to provide an image forming apparatus and an image forming method, which prevents the erroneous detection and reduces the waiting time.

According to the present invention, when an image forming apparatus is disabled due to a cause rather than the detection of the toner empty condition, it is determined whether a recovery operation is a first recovery operation or a second recovery operation. The first recovery operation is associated with a mounting/dismounting of the toner cartridge performed from when the image forming apparatus is disabled until when the recovery operation begins. The second recovery operation is not associated with the mounting/dismounting. A toner supply control controls the toner supply operation when the recovery operation is performed on condition that the empty memory memorizes that the toner empty detector detects the empty condition. When the recovery operation is the first recovery operation, the toner supply control allows the toner to be supplied into the developer housing. While, when the recovery operation is the second recovery operation, the toner supply control prohibits the toner from being supplied into developer housing.

DETAILED DESCRIPTION OF THE PREFERRED EMBODIMENTS

Figure 1:
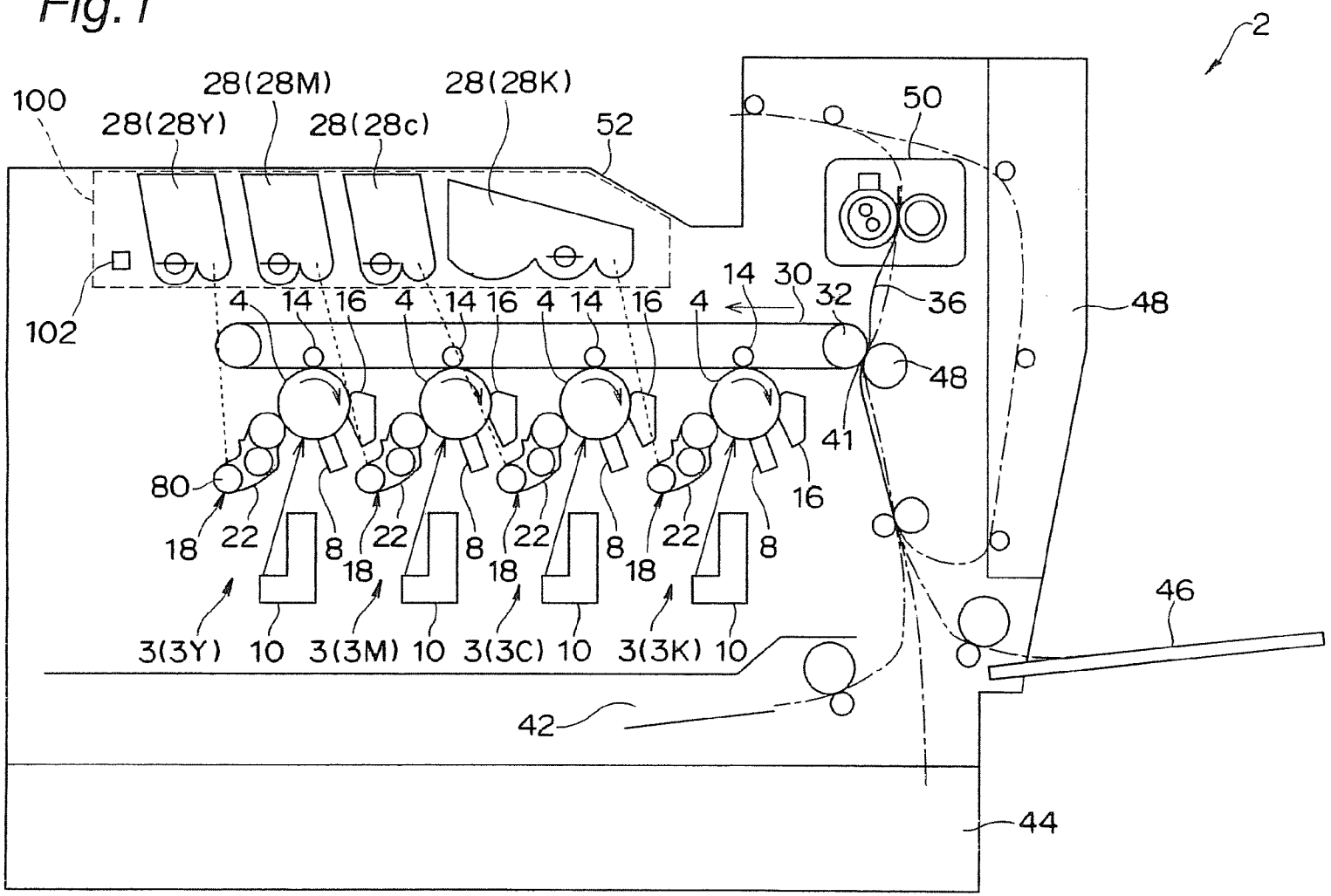
FIG. 1 is an elevational view schematically showing the construction of an image forming apparatus according to the present invention.

Preferred embodiments according to the present invention will be described with reference to the accompanying drawings. Although several terminologies that imply specific directions, for example, "upper", "lower", "left", "right", "clockwise", and "counterclockwise", are used in the following description to facilitate the understanding of the present invention with reference to the drawings, it is to be noted that the present invention is not limited by the meanings of such terminologies. In addition, like reference numerals are used for like parts in the description and drawings.

FIG. 1 shows a schematic construction of an image forming apparatus, generally indicated at 2, according to an embodiment of the present invention. The image forming apparatus 2 is an electrophotographic image forming device such as a copy machine, a printing machine, a facsimile machine, and a multi-function peripheral. Among various kinds of electrophotographic image forming apparatuses having been proposed, the image forming apparatus shown in the drawing is a tandem-type color image forming apparatus. However, the present invention is not limited to this image forming apparatus and can be similarly applied to a four-cycle type or a direct transfer-type color image forming apparatus, in which a toner image on an electrostatic latent image bearing member is directly transferred onto a recording sheet. Also, it should be noted that the present invention is equally applied to a black-and-white, i.e., monochrome, image forming apparatus.

The image forming apparatus 2 has an endless, intermediate transfer belt 30. Four image forming units 3 (3Y, 3M, 3C and 3K) for forming toner images with different color developers of yellow (Y), magenta (M), cyan (C) and black (K) are arranged in this order from left to right in the drawing, adjacent a lower belt run of the intermediate transfer belt 30.

The image forming unit 3 has as an electrostatic latent image bearing member, or cylindrical photoreceptor 4. A charging device 8 for charging the outer peripheral surface of the photoreceptor 4, an exposing device 10 for projecting image on the photoreceptor 4 to form an electrostatic latent image, a developing device 18 for supplying each color toner to the photoreceptor 4 to visualize the electrostatic latent image, a primary transfer roller 14 for forcing the immediate transfer belt 30 onto the photoreceptor 4, and a photoreceptor cleaning device 16 are arranged around the photoreceptor 4 sequentially in its rotational direction (i.e., clockwise direction in the drawing).

The developing unit 18 has a housing 22 for accommodating developer material made of small particles for development. In this embodiment, the developer material is a two-component developer material including two major components of toner and carrier. The toner in the housing 22 is consumed in the developing process. Meanwhile the carrier in the developer housing 22 is hardly consumed in the developing process. Alternatively, a single-component developer material including a major component of toner may be used.

Four toner cartridges 28 containing respective toners are provided, for example, at upper portions of the image forming apparatus 2 to supply respective toners to the associated housings 22. Specifically, each toner is supplied from the toner cartridge 28 to the associated developer housing 22 as the toner in the housing 22 is consumed, so that a ratio (M/N) of a toner amount (M) to a carrier amount (N) is maintained constant at substantially a predetermined value in each housing 22.

Figure 9:
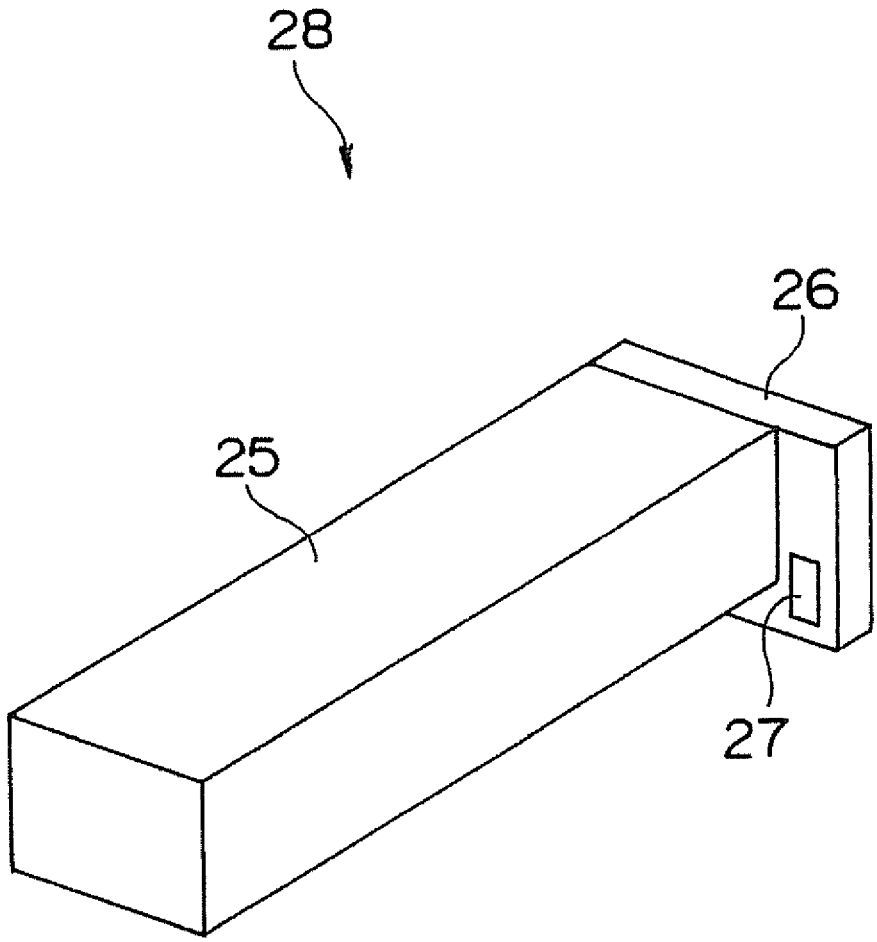
FIG. 9 is a perspective view showing a toner cartridge.

Each toner cartridge 28 is detachably mounted in the image forming apparatus 2. This allows that, when the toner cartridge 28 becomes a toner empty condition, it is replaced by a new one. As shown in FIG. 9, the toner cartridge 28 has a first end portion 26 which is positioned on the front or operation side of the apparatus 2 on condition that the cartridge is mounted in the image forming apparatus 2 and a second end portion 25 extending away from the operation side toward rear side of the apparatus. The first end portion 26 has a memory such as non-volatile memory 27 exposed on the rear surface of the first end portion 26. The non-volatile memory 27 acts as a cartridge memory-unit for memorizing information. The information may include an identification of the toner cartridge 28.

Referring again to FIG. 1, similar to the conventional image forming apparatus, the image forming apparatus 2 has a door, for example, front door 100 on its front so that, by opening the front door, a front portion of the internal structure of the apparatus is exposed to users or operators, allowing a replacement operation of the toner cartridge 28. In order to detect opening and closing of the front door 100, the apparatus 2 has a suitable sensor or switch 102.

In this embodiment, the apparatus 2 has a reverse unit 48 equipped on its right side for forming a transport pass for reversing the recording sheet upside down. In order to remove the sheet jammed in the pass, a housing of the unit 48 is pivotally mounted on the apparatus housing to open the pass. The opening and closing of the unit 48 is also detected by a sensor or switch mounted on the apparatus housing.

In the image forming operation, the toner image formed on the photoreceptor 4 in each image forming unit 3 is transferred from the photoreceptor 4 to the belt 30 at the contact region between the photoreceptor 4 and the belt 30. By the sequential transfer operations between the photoreceptors and the belt, the toner images of yellow, magenta, cyan and black are superimposed on the belt 30 to form a full-color toner image.

A secondary transfer roller 40 is provided outside and adjacent a right belt portion supported by a roller 32 for bringing the recording sheet 36 into contact with the belt 30 to form a second transfer region 41. The recording sheet 36 is conveyed selectively from feed unit 42, 44, 46 or the transport pass in the reverse unit 48 to the contact region between the secondary transfer roller 40 and the belt 30. The superimposed toner image on the belt 30 is transferred onto the recording sheet 36 at the second transfer region 41.

After being passed through the secondary transfer region 41, the recording sheet 36 is conveyed into a fixing unit 50 where the toner image is fused on the recording sheet 36. Then, the recording sheet 36 is conveyed to a discharging unit 52 having a discharge tray defined by an upper housing portion of the apparatus, on which the recording sheet is discharged and placed.

Figure 2:
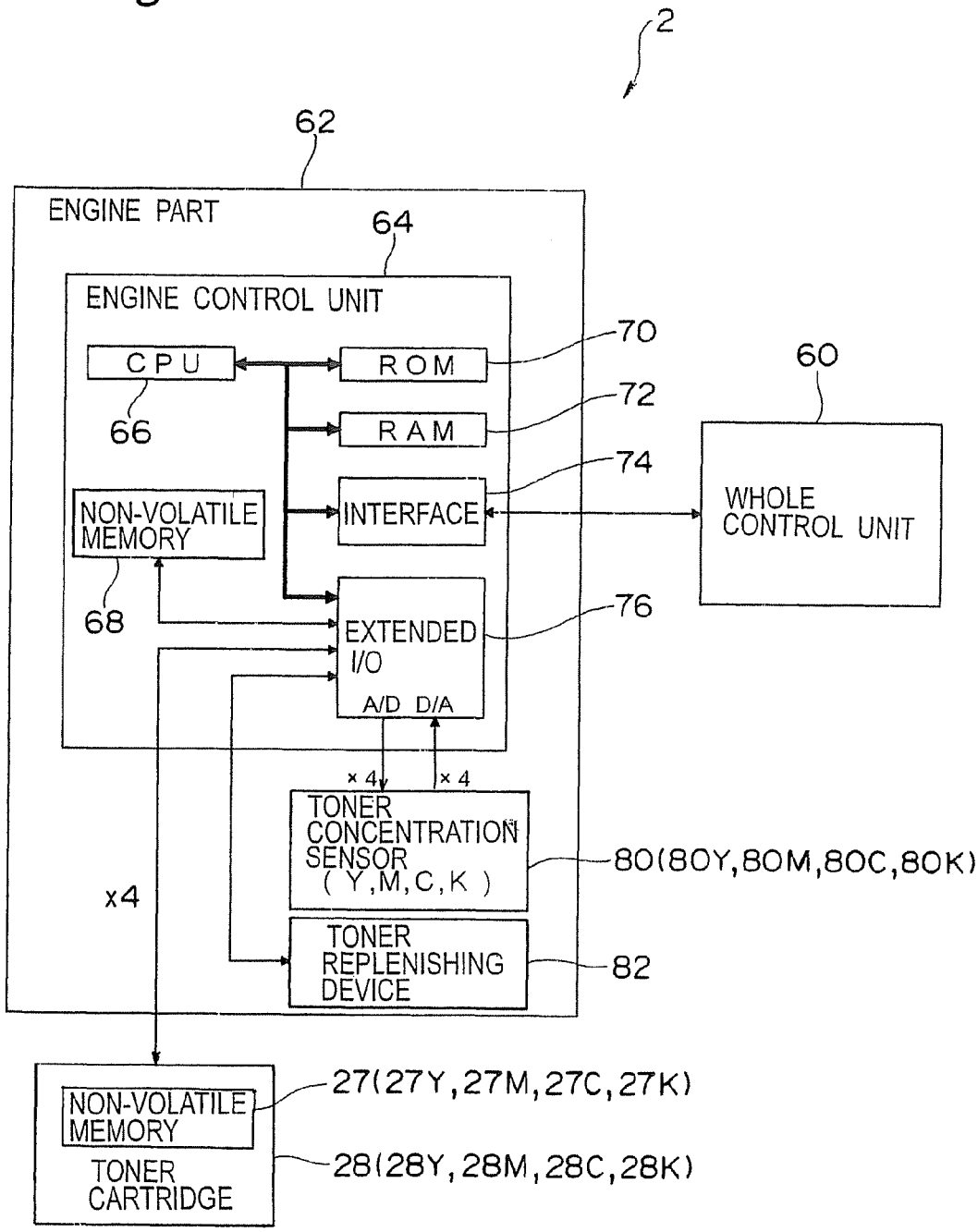
FIG. 2 is a block diagram showing the electrical construction of the image forming apparatus.

Referring to FIG. 2, the image forming apparatus 2 has an engine 62 including various electrical, mechanical, and electromechanical devices. To control the devices, the engine 62 has an engine control 64. The engine control 64 has central processing unit (CPU) 66, read only memory (ROM) 70, random access memory (RAM) 72, interface 74, extended input/output (I/O) 76 connected to one another, and non-volatile memory 68 connected to the extended I/O 76. The non-volatile memory 68 functions as an empty memory unit 96 and an identification information memory unit 104 as will be described below.

The image forming apparatus 2 includes a central control 60 connected to the interface 74 of the engine control 64 for controlling the whole operations of the apparatus. Although not shown, the central control 60 may be connected to external auxiliary devices such as a scanner and a finisher.

The engine unit 62 further includes sensors 80 (80Y, 80M, 80C and 80K) for detecting concentrations of toners in respective developer housings 22. The sensors 80 are connected to the extended I/O 76. Also, the non-volatile memories 27 of the toner cartridges 28 are connected to the extended I/O 76 so that the detected toner concentrations are transmitted through the I/O 76 to the memories 27 where they are memorized.

The toner concentration sensors 80 are provided in the developer housings 22 to detect concentrations, i.e., toner to carrier ration (M/N), of respective toners accommodated in the developer housings 22. Preferably, the sensor 80 is a magnetic sensor capable of detecting a magnetic permeability which is substantially proportion to the ratio (M/N) of the toner amount (M) against the carrier amount (N). As discussed above, the amount of carrier in the developer housing 22 is maintained substantially constant. This allows the sensor 80 to detect the amount of toner in the developer housing 22.

The engine unit 62 further includes a toner supply device 82. The toner supply device 82 transports toners from the toner cartridges 28 to the respective developer housings 22. This allows that, when a residual amount of toner in the developer housing detected by CPU using a signal transmitted from the associated sensor becomes less than the required amount, the toner supply device 82 is activated to supply the toner from the toner supply cartridge 28 to the associated developer housing 22. The toner supply operation continues until the sensor 80 detects that the amount of toner reaches the predetermined amount. If the amount of toner in the developer housing 22 does not reach the predetermined value even after a predetermined time of operation of the toner supply device 82, it is determined that the associated toner cartridge 28 is in the empty condition. In this instance, after the empty toner cartridge 28 is replaced by a new toner cartridge, the toner supply device 82 is activated to transport the toner from the replaced toner cartridge 28 to the developer housing 22, which is controlled by a toner supply control 112 which will be described below.

Figure 3:
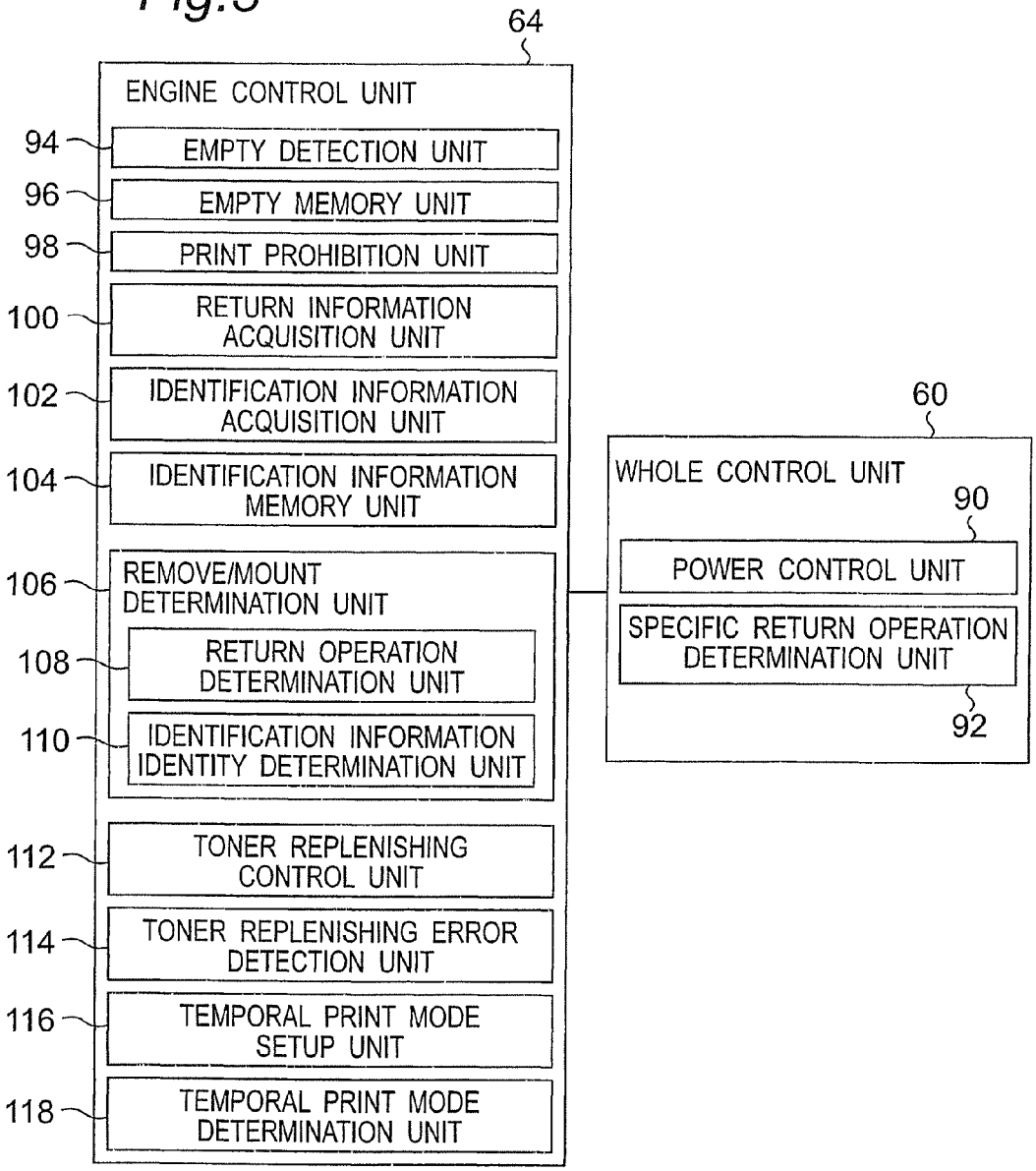
FIG. 3 is a diagram showing the construction of an engine control and a central control.

FIG. 3 shows a general construction of the central and engine controls, 60 and 64. As shown in the drawing, the engine control 64 has an empty detection unit 94 that detects the toner empty condition of the toner cartridge 28 when the toner amount detected by the sensor 80, i.e., the ratio (M/N) of the toner amount (M) to the carrier amount (N), is less than the predetermined amount. The toner empty condition is memorized in the empty memory unit 96. Also, when the toner empty condition is detected by the empty detection unit 94, an image forming operation is prohibited by a prohibition unit 98, which prevents the image forming operation from being performed under the insufficient condition of toner. After the replacement of the toner cartridge 28, the toner is supplied by the toner supply device 82, which clears the prohibition of the image forming operation.

The toner cartridge newly installed in the apparatus carries a unique identification which is detected by an ID verification unit described below. The replacement of the toner cartridge can be detected in different manners by, for example, detecting the replacement operation or detecting the density change in the resultant images.

The engine control 64 includes an ID acquisition unit 102 and an ID memory unit 104. The ID acquisition unit 102 acquires the identification memorized in the non-volatile memory 27, based on a signal transmitted from the non-volatile memory (cartridge memory unit) 27 of the toner cartridge 28 installed in the image forming apparatus 2. The ID memory unit 104 memorizes the ID acquired by the ID acquisition unit 102.

The engine control 64 also has an initial or default print mode setup unit 116 for setting an initial print mode on or off, and an initial print mode determination unit 118 for determining whether the initial print mode is set on or off. When the initial print mode is set on and the toner empty condition of the toner cartridge 28 for the color toner (more specifically, the yellow toner, magenta toner or cyan toner) is detected by the empty detection unit 94, only the monochrome image forming operation is permitted. The initial print mode may be changed by the operation of users, for example.

The engine control 64 further includes a return information acquisition unit 100, a mount/dismount determination unit 106, a toner transportation control 112, and a toner supplying error detection unit 114. The mount/dismount determination unit 106 further includes a recovery operation determination unit 108 and an ID information identity determination unit 110. The functions of those units will be described below with reference to FIGS. 4-7.

The central control 60 includes a power control 90 for controlling a power supply to some or every electric part of the image forming apparatus 2, and a specific recovery operation determination unit 92 for specifically determining the recovery operation based on a signal transmitted from the power control 90. The functions of those units will be described below with reference to FIG. 5.

Typically, once the toner empty is detected, the image forming operation is prohibited by the print prohibit unit 98. In this instance, the toner cartridge 28 is exchanged by the user, which clears the toner empty condition. There may be the case in which the initial print mode is set on by the initial print mode setup unit 116 or the new toner cartridge 28 cannot be mounted immediately, and also the main power supply or auxiliary power supply is turned off or the a power saving is started without the replacement of the toner cartridge 28 or without clearing the toner empty condition.

When the main power supply is turned off, CPU 66 of the engine control 64 and CPU of the central control 60 are deactivated. When the auxiliary power supply is turned off, the CPU 66 of the engine control 64 is deactivated but the CPU of the central control 60 is kept activated. The power saving may be a condition in which the power supply to the CPU 66 of the engine control 64 is cut to halt the control by the engine control 64 and thereby to turn off the fixing device 50 or a condition in which the CPU 66 of the engine control 64 still functions while the set temperature of the fixing device 50 is lowered.

The opening and closing of the front and side doors of the apparatus 2 is detected by the CPU 66 of the engine control 64. This results in that, when the main power supply or the auxiliary power supply is turned off or the apparatus is turned into the power saving condition and thereby the CPU 66 is deactivated, neither the opening or closing of the door can be detected. This results in that, even if the toner cartridge is replaced by the new one during the CPU 66 is in off state, the replacement is not recognized by the CPU 66.

As such, according to the conventional control method, the toner transport operation is performed immediately after the recovery operation regardless of that no toner is supplied into the developer housing 22, during which the user has to wait regardless of that no toner is supplied into the developer housing 22. In this instance, the toner supply error is detected repeatedly and then it is erroneously determined that the toner supply device 82 be failed.

In view of the foregoing, the toner supply operation is controlled by the toner supply control 112 in the following embodiments.

First Embodiment

Figure 4:
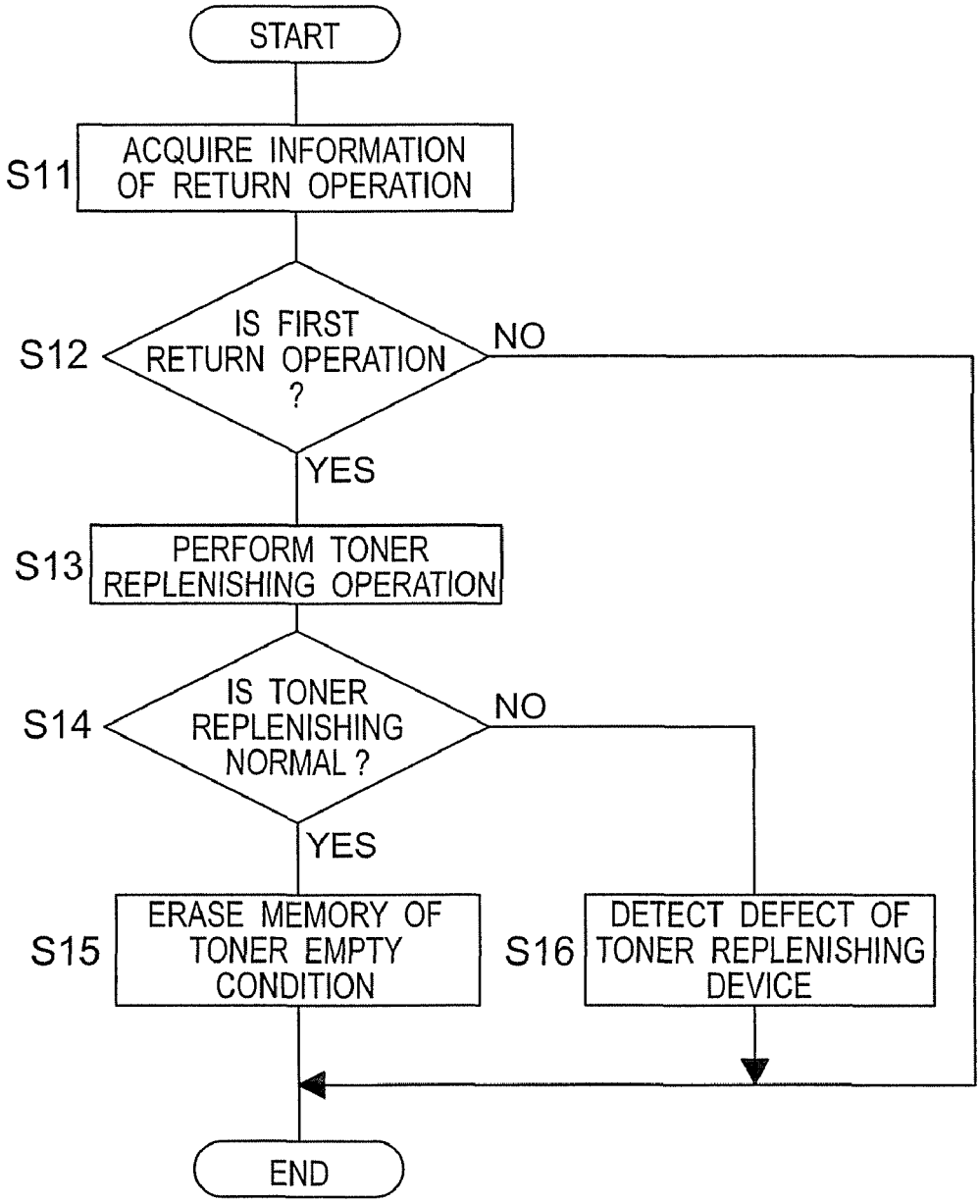
FIG. 4 is a flowchart showing the process of a toner supply control according to a first embodiment.
Figure 5:
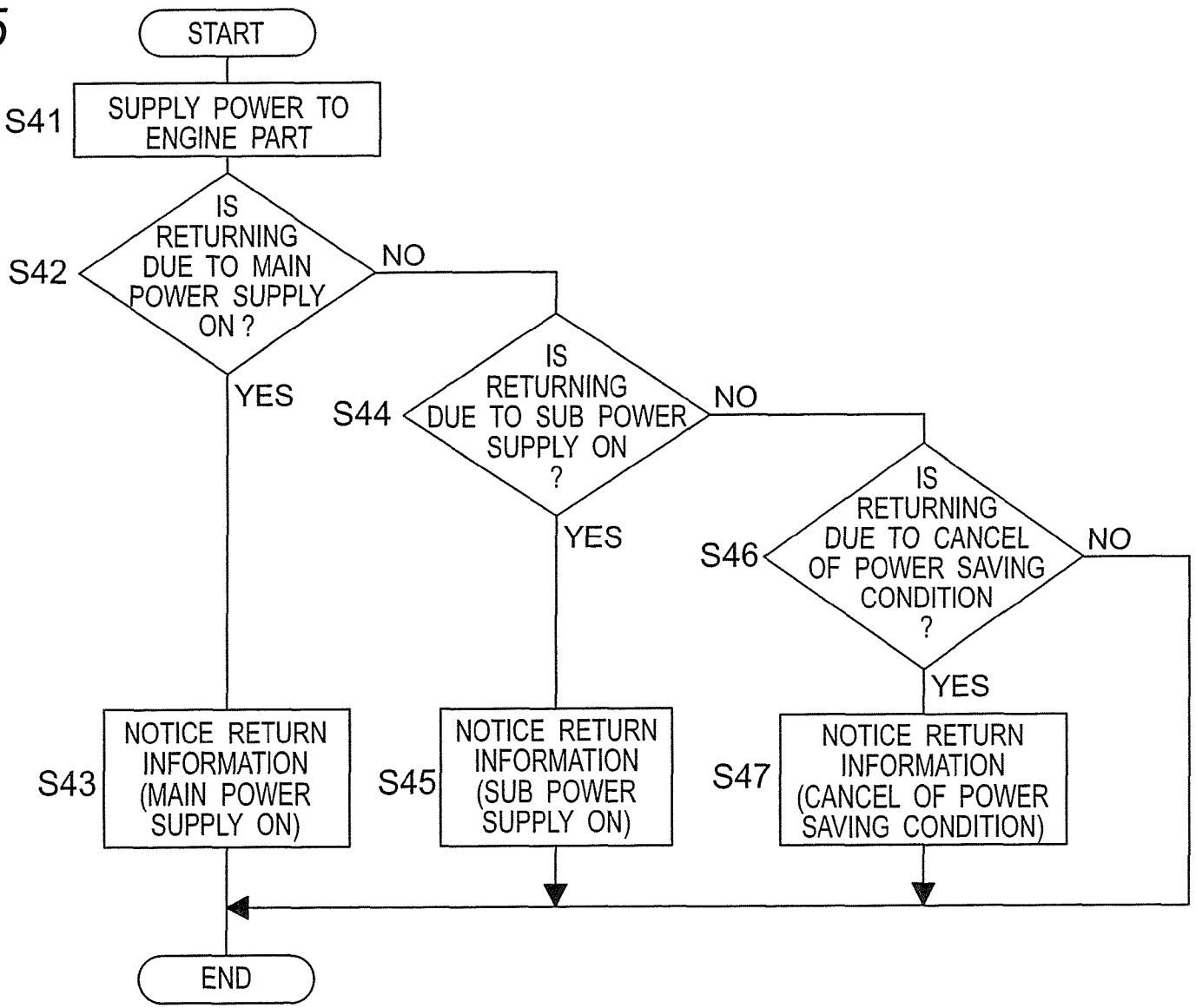
FIG. 5 is a flowchart showing the process of control to determine a recovery operation in the central control.

Referring to FIGS. 4 and 5, the toner supply control according to a first embodiment of the present invention will be described. FIG. 4 is a flowchart showing a flow of process performed in the toner supply control 112. This process is started when the empty memory unit 96 memorizes the toner empty and also any recovery operation such as turning on the main or auxiliary power supply, clearing the power save mode, or closing of the front door is performed.

As shown in FIG. 4, at step S11 the information related to the recovery operation is acquired by the return information acquisition unit 100 from a signal transmitted from the power control 90 of the central control 60 through the specific recovery operation determination unit 92 and a signal generated in the engine control 64. The control for determining the recovery operation specifically in the central control 60 will be described below with reference to FIG. 5. In the recovery operation, the central control 60 controls processes relating to turn-on operation of the main power supply, turn-on operation of the auxiliary power supply, and clearing operation of the power saving condition to turn off the engine 62. The engine control 64 controls processes relating to closing operation of the front door, closing operation of the side door which would be opened and closed at the jam recovery, for example, and to clearing operation of the power saving condition in which the engine 62 is off. In the power saving, "engine 62 is off" means that the power supply to the CPU 66 is turned off to de-energize the engine control 64 and thereby to turn off the fixing device 50, while "engine 62 is on" means that the CPU 66 of the engine control 64 is activating and the set temperature of the fixing device 50 is lowered.

At step S12, it is determined whether the recovery operation is a first recovery operation, a second recovery operation, or a third recovery operation by the recovery operation determination unit 108 of the mount/dismount determination unit 106, based on the information acquired at step S11.

The first recovery operation is an operation which indicates that the toner cartridge 28 should have been replaced from when the image forming is prohibited due to the turn-off of the main or auxiliary power source, the switching into the power saving mode, or the opening of the front door until when the recovery operation is initiated. For example, the first recovery operation includes the operation to turn on the main power supply and the operation to close the front door. The second recovery operation is an operation which indicates that the toner cartridge 28 has been replaced from when the image forming operation is disabled by the factors other than the detection of the toner empty condition until when the recovery operation is initiated. For example, the second recovery operation includes the operation to turn on the auxiliary power supply and the operation to clear the power saving condition, i.e., the engine 62 is turned off. The third recovery operation is an operation which indicates the toner supply operation is not needed regardless of whether the toner cartridge 28 is exchanged. For example, the third recovery operation includes the operation to close the side door, and the operation to clear the power saving condition, i.e., the engine 62 is turned on.

If it is determined at step S12 whether the recovery operation is set to be the first recovery operation, rather than the second or third operation, the program proceeds to step S13. Otherwise, the program is completed.

At step S13, the toner supply operation is performed by the toner supply device 82. In this operation, when the required amount of toner is contained in the toner cartridge 28, the toner is supplied from the toner cartridge 28 to the developer housing 22, so that the ratio (M/N) of the toner amount (M) to the carrier amount (N) in the developer housing 22 is recovered.

At step S14, it is determined whether the toner supply operation is performed properly, on the basis of the output from the toner supply error detection unit 114. More specifically, the sensor 80 detects the ratio (M/N) of the toner amount (M) to the carrier amount (N) in the developer housing 22. Using the detected ratio (M/N), it is determined whether the amount of toner in the developer housing has reached the predetermined amount. If it is determined at step S14 that the toner has been properly supplied, the program proceeds to step S15. Otherwise, the program proceeds to step S16.

At step S15, the toner empty information is cleared from the empty memory unit 96 and the program is completed.

At step S16, it is detected that the toner supply device 82 is failed and then the program is completed. Although a single detection of the improper toner supply results in that the toner supply device 82 is determined to be failed, it may be determined that the toner supply device 82 is failed when the improper supply is detected several times in series at step S14.

As described above, according to the toner supply control in this embodiment, the toner supply is performed only when the first recovery operation in which it is assumed that the toner cartridge 28 has been exchanged. This ensures that the toner supply operation is performed only when it is necessary, which significantly reduces the user's waiting time. Also, it is highly likely that the toner cartridge 28 contains the required amount of the toner under the first recovery operation, an erroneous detection of the failure of the toner supply device 62 is prevented. Furthermore, the first recovery operation allows the toner supply operation even when no replacement of the toner cartridge 28 is performed. This ensures users to dismount the toner cartridge 28 from the apparatus, shake it for distributing the residual toner within the cartridge 28, and then remount the same into the apparatus. Moreover, according to the first embodiment, there is no need to confirm whether the ID information of the toner cartridge 28 is the same as that memorized in the non-volatile memory 68 of the engine control 64, which significantly simplifies the control.

Referring to FIG. 5, the recovery operation in the central control 60 will be described in detail.

The control process in FIG. 5 is performed when the recovery operation is performed under the condition that the engine 62 is off, i.e., when the main power supply is turned on, the auxiliary power supply is turned on, or the power saving condition (the engine 62 is off) is turned off.

First, at step S41, a power is supplied to the engine 62 under the control of the power control 90 in accordance with the recovery operation, and the program proceeds to step S42.

At step S42, the specific recovery operation determination unit 92 determines based upon the signal transmitted from the power control 90 whether the recovery operation is triggered by the fact that the main power is turned on. If it is determined at step S42 that the recovery operation is triggered by the fact that the main power supply has been turned on, the program proceeds to step S43. Otherwise, the program proceeds to step S44.

At step S43, the information that the recovery operation is initiated by turning on the main power supply is transmitted from the specific recovery operation determination unit 92 to the return information acquisition unit 100 of the engine control 64, and the process is completed.

At step S44, the specific recovery operation determination unit 92 determines whether the recovery operation is initiated by turning on the auxiliary power supply, based on the signal transmitted from the power control 90. If it is determined at step S44 that the recovery operation is initiated by the turning on the auxiliary power supply, the program proceeds to step S45. Otherwise, the program proceeds to step S46.

At step S45, the information that the recovery operation is initiated by turning on the auxiliary power supply is transmitted from the specific recovery operation determination unit 92 to the return information acquisition unit 100 of the engine control 64, and the process is completed.

At step S46, the specific recovery operation determination unit 92 determines whether the recovery operation is triggered by turning off the power saving condition, based on the signal transmitted from the power control 90. If it is determined at step S46 that the recovery operation is triggered by turning off the power saving condition, the program proceeds to step S47. Otherwise, the process is completed.

At step S47, the information that the recovery operation is triggered by turning off the power saving condition is transmitted from the specific recovery operation determination unit 92 to the return information acquisition unit 100 of the engine control 64, and the process is completed.

Second Embodiment

Figure 6:
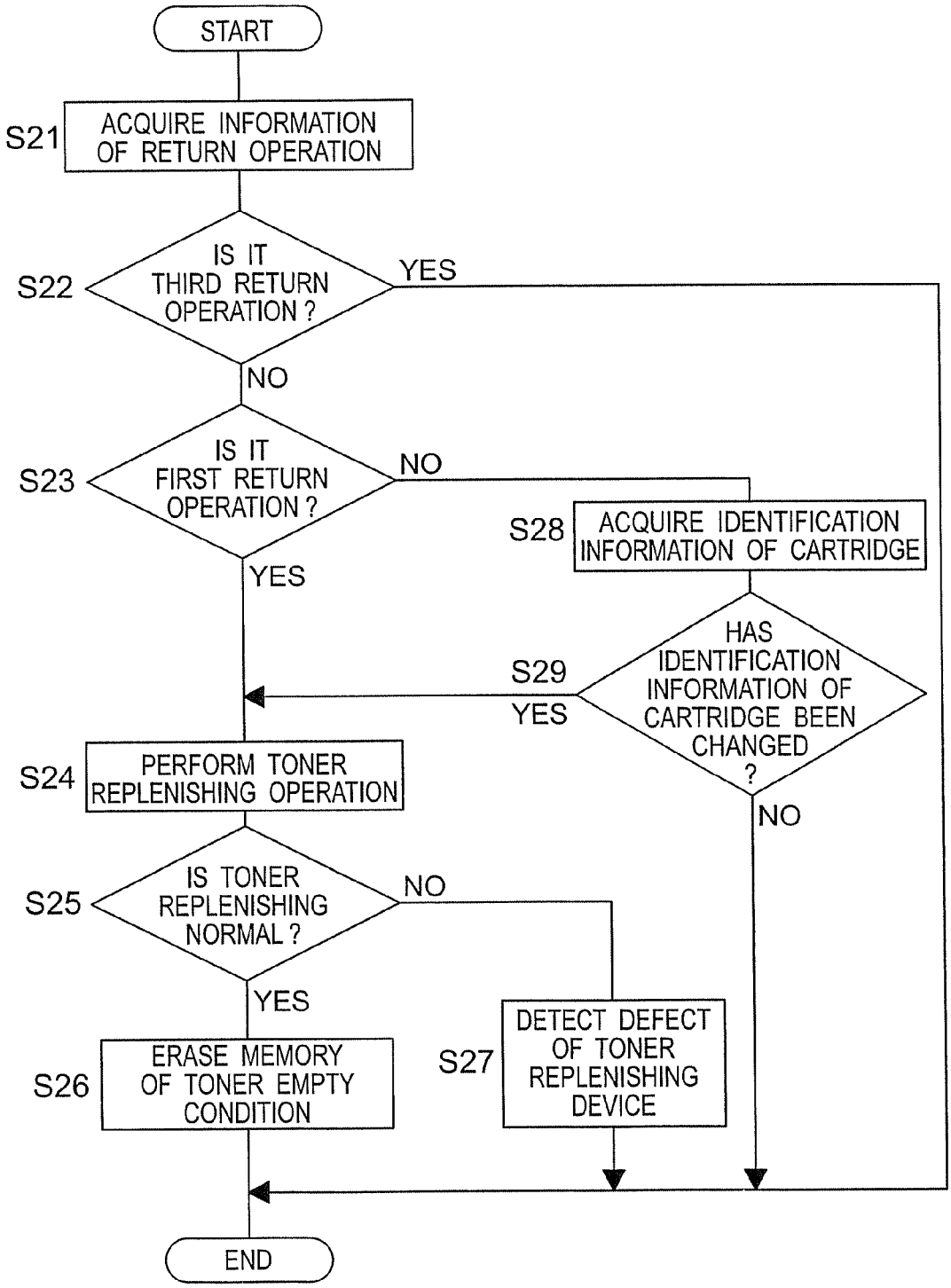
FIG. 6 is a flowchart showing the process of toner supply control according to a second embodiment.

Referring to FIG. 6, the toner supply control according to a second embodiment will be described. The control process shown in FIG. 6 is performed in the toner supply control 112 after the recovery operation is performed under the condition that the fact that toner empty condition has been memorized in the empty memory unit 96 is memorized in the empty memory unit 96, similar to the first embodiment.

As shown in FIG. 6, at step S21, similar to the step S11 in FIG. 4, the information of the recovery operation is acquired by the return information acquisition unit 100, based on the signal transmitted from the power control 90 of the central control 60 through the specific recovery operation determination unit 92 and the signal in the engine control 64. The control in which the recovery operation is specifically determined in the central control 60 is performed similar to the first embodiment.

At step S22, it is determined whether the recovery operation is the third recovery operation by the recovery operation determination unit 108 of the mount/dismount determination unit 106, based on the information acquired at step S21. If it is determined that it is not the third recovery operation at step S22, the program proceeds to step S23. Otherwise, since the toner supply operation is not needed regardless of the mounting/dismounting of the toner cartridge 28, the process is completed.

At step S23, the recovery operation determination unit 108 of the mount/dismount determination unit 106 determines whether the recovery operation is the first recovery operation or the second recovery operation, based on the information acquired at step S21. If it is determined that it is the first recovery operation at step S23, the program proceeds to step S24. Otherwise, the program proceeds to step S28.

At step S24, the same toner supply operation as at step S13 in FIG. 4 is performed. Then, the program proceeds to step S25.

At step S25, similar to the step S14 in FIG. 4, it is determined whether the toner has been properly supplied.

If it is determined at step S25 that the toner has been properly supplied, the memory of the toner empty condition is cleared from the empty memory unit 96. Then, the process is completed similar to step S15 in FIG. 4.

If it is determined at step S25 that the toner has not been properly supplied, the associated failure of the toner supply device 82 is detected at step S27 and the process is completed similar to step S16 in FIG. 4.

At step S28, the identification information of the toner cartridge 28 mounted on the image forming apparatus 2 is acquired by the identification information acquisition unit 102. Then, the program proceeds to step S29.

It is determined at step S29 whether the identification information of the toner cartridge 28 has been changed before or after the recovery operation, by the identification information identity determination unit 110 of the mount/dismount determination unit 106. More specifically, it is determined whether the identification information acquired by the identification information acquisition unit 102 at step S28 coincides with the identification information memorized in the identification information memory unit 104 before the recovery operation.

If it is determined at step S29 that the identification information of the toner cartridge 28 has been changed, it is recognized that the toner cartridge 28 has been exchanged and then the program proceeds to step S24, similar to the case where the first recovery operation is determined at step S23, where the toner is supplied after step S24 and the process is completed.

If it is determined at step S2 that the identification information of the toner cartridge 28 is not changed 9, it is recognized that the toner cartridge 28 is not exchanged and therefore the process is completed without performing the toner supply operation.

The toner supply control is performed as described above, according to the second embodiment, similar to the first embodiment, the user's waiting time is significantly reduced, and the erroneous detection of the failure of the toner supply device 82 is prevented. Furthermore, according to the second embodiment, in addition to the process by the recovery operation determination unit 108 at step S23, the process by the identification information identity determination unit 110 is performed at step S29, which ensures a reliable determination of the mounting/dismounting of the toner cartridge 28.

Third Embodiment

Figure 7:
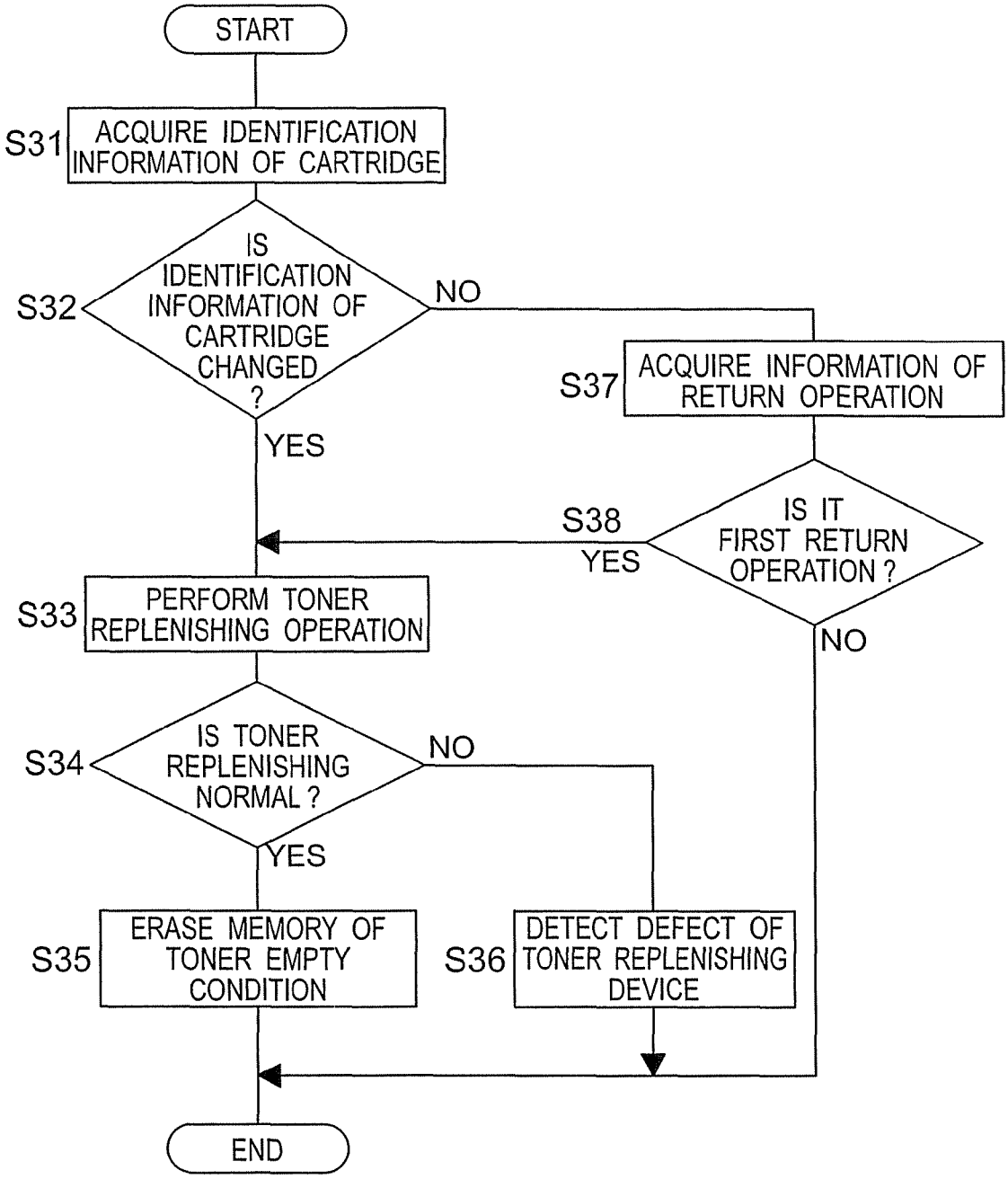
FIG. 7 is a flowchart showing the process of toner supply control according to a third embodiment.

With reference to FIG. 7, the toner supply control according to a third embodiment will be described. The control shown in FIG. 7 is performed in the toner supply control 112 after the recovery operation is performed under the condition that the fact that the toner empty condition has been memorized in the empty memory unit 96 similar to the first embodiment (FIG. 4).

As shown in FIG. 7, at step S31, the identification information of the toner cartridge 28 mounted on the image forming apparatus 2 is acquired by the identification information acquisition unit 102. Then, the program proceeds to step S32.

At step S32, it is determined whether the identification information of the toner cartridge 28 has been changed before or after the recovery operation by the identification information identity determination unit 110 of the mount/dismount determination unit 106 similar to step S28 in FIG. 6.

If it is determined at step S32 that the identification information of the toner cartridge 28 has been changed, it is recognized that the toner cartridge 28 has been exchanged and therefore the program proceeds to step S33 in which the toner supply operation is performed similar to step S13 in FIG. 4. Then, it is determined at step S34 whether the toner has been properly supplied, similar to step S14 in FIG. 4. If it is determined at step S34 that the toner has been properly supplied, the memory of the toner empty condition is cleared from the empty memory unit 96 at step S35, similar to step S15 in FIG. 4, and then the process is completed. If it is determined at step S34 that the toner has not been properly supplied, the associated failure of the toner supply device 82 is detected at step S34, similar to step S16 in FIG. 4, and the process is completed.

If it is determined at step S32 that the identification information of the toner cartridge 28 has not been changed, it is recognized that the toner cartridge 28 has not been exchanged and therefore the toner supply operation is not performed immediately and the program proceeds to step S37.

At step S37, similar to step S11 in FIG. 4, the information of the recovery operation is acquired by the return information acquisition unit 100, based on the signal transmitted from the power control 90 of the central control 60 through the specific recovery operation determination unit 92, and the signal in the engine control 64. The control in which the recovery operation is specifically determined in the central control 60 is performed similar to the first embodiment (FIG. 5).

At step S38, it is determined whether the recovery operation is the first recovery operation, by the recovery operation determination unit 108 of the mount/dismount determination unit 106, based on the information acquired at step S37.

If it is determined at step S38 that the recovery operation is the first recovery operation, it is recognized that the toner cartridge 28 has been removed and mounted and therefore the program proceeds to step S33 where the toner supply operation is performed. Then, the toner supply operation is performed and the process is completed.

If it is determined at step S38 that the recovery operation is the second recovery operation or the third recovery operation, the process is completed without performing the toner supply operation.

Thus, according to the third embodiment, only when it is determined at step S32 that the identification information of the toner cartridge 28 has not been changed, it is then determined at step S38 whether the recovery operation is the first recovery operation, which is different from the second embodiment. Similar to the second embodiment, however, if it is determined that the recovery operation is the first recovery operation, the toner supply operation is performed. Also, if the recovery operation is the second recovery operation, the toner supply operation is performed only when the identification information of the toner cartridge 28 is changed. Therefore, the same operational advantage as in the second embodiment can be provided.

Fourth Embodiment

Figure 8:
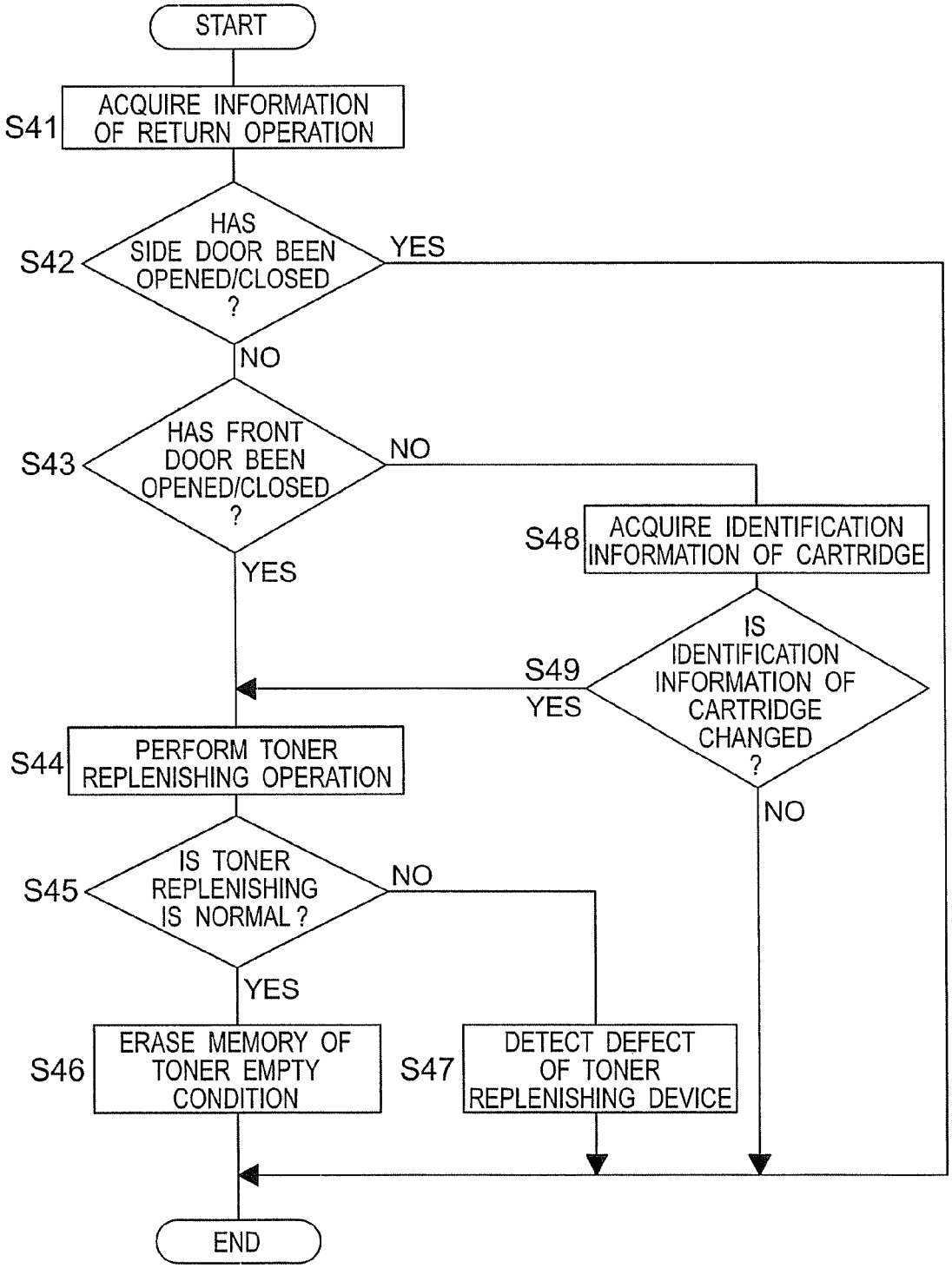
FIG. 8 is a flowchart showing the process of toner supply control according to a fourth embodiment.

Referring to FIG. 8, the toner supply control according to a fourth embodiment of the present invention will be described. The control shown in FIG. 8 is performed in the toner supply control 112 after the recovery operation is performed under the condition that the fact that the toner empty condition has been memorized in the empty memory unit 96, similar to the first embodiment.

As shown in FIG. 8, similar to step S11 in FIG. 4, the information of the recovery operation is acquired at step S41 by the return information acquisition unit 100 based on the signal transmitted from the power control 90 of the central control 60 through the specific recovery operation determination unit 92 and an the signal inside the engine control 64. The control in which the recovery operation is specifically determined in the central control 60 is performed similar to the first embodiment (see FIG. 5).

It is determined at step S42 whether the side door has been opened and closed, based on the information acquired at step S41. More specifically, it is determined whether the recovery operation contains only the operation to close the side door and does not contain the other recovery operation, such as operations for turning on the main power supply, turning on the auxiliary power supply, clearing the power saving condition, or opening the front door. If it is determined at step 42 that the side door has been opened and closed, namely, if it is determined that the recovery operation only contains the operation to close the side door, it is determined that the toner cartridge 28 is not exchanged, and the process is completed without performing the toner supply operation. If it is determined that the side door has not been opened or closed at step S42, namely, if it is determined that the recovery operation contains the recovery operation other than closing the side door, the program proceeds to step S43.

It is determined at step S43 whether the front door has been opened and closed based on the information acquired at step S21. More specifically, it is determined whether the recovery operation contains the operation to close the front door. If it is determined at step S43 that the front door has been opened and closed, namely, if it is determined that the recovery operation contains the operation to close the front door, the program proceeds to step S44. Otherwise, the program proceeds to step S48.

At step S44, the same toner supply operation as at step S13 in FIG. 4 is performed and the program proceeds to step S45.

At step S45, similar to step S14 in FIG. 4, it is determined whether the toner has been properly performed.

If it is determined at step S45 that the toner has been properly supplied, the memory of the toner empty condition is cleared from the empty memory unit 96 at step S46 and the process is completed, similar to step S15 in FIG. 4.

If it is determined at step S45 that the toner has not been properly supplied, the associated failure of the toner supply device 82 is detected at step S47 and the process is completed, similar to step S16 in FIG. 4.

At step S48, the identification information of the toner cartridge 28 mounted on the image forming apparatus 2 is acquired by the identification information acquisition unit 102, and the program proceeds to step S49.

At step S49, it is determined whether the identification information of the toner cartridge 28 has been changed before or after the recovery operation by the identification information identity determination unit 110 of the mount/dismount determination unit 106. More specifically, it is determined whether the identification information acquired at step S48 by the identification information acquisition unit 102 coincides with the identification information in the identification information memory unit 104 memorized before the recovery operation.

If it is determined at step S49 that the identification information of the toner cartridge 28 has been changed, it is recognized that the toner cartridge 28 has been exchanged and the program proceeds to step S44. Then, similar to the case where it is determined that the front door has been opened and closed at step S43, the toner is supplied after step S44 and the process is completed.

If it is determined at step S49 that the identification information of the toner cartridge 28 has not been changed, it is recognized that the toner cartridge 28 has not been exchanged and the process is completed without performing the toner supply operation.

Thus, according to the fourth embodiment, since the toner supply operation is not performed when the recovery operation contains only the operation to close the side door, the user's waiting time is reduced, and the erroneous detection of the failure of the toner supply device 82 is prevented. Also, even when it is determined at step S43 that the front door has not been opened and closed, the process by the identification information identity determination unit 110 is performed at step S49. Therefore, it can be determined more correctly that the toner cartridge 28 has been removed and mounted.

Although the embodiments of the present invention have fully been described above, the present invention is not limited thereto.

What is claimed is:

1. The image forming apparatus, comprising:

a cartridge memory which is provided in a toner cartridge to memorize an identification information of the toner cartridge;

an identification information acquisition unit which acquires the identification information from the cartridge memory of the toner cartridge mounted on the image forming apparatus;

an identification information memory unit which memorizes the identification information acquired by the identification information acquisition unit; and an identification information identity determination unit which determines whether the identification information of the cartridge mounted on the image forming apparatus coincides with the identification information memorized in the identification information memory unit, wherein, when a recovery operation contains an operation to turn on a power supply, a toner supply control performs the toner supply operation when it is determined that the identification information of the mounted cartridge is different from the identification information memorized in the identification information memory unit by the identification information identity determination unit, the toner supply control does not perform the toner supply operation when it is determined that the identification information of the mounted cartridge coincides with the identification information memorized in the identification information memory unit by the identification information identity determination unit.

2. An image forming apparatus, comprising:

a developer housing which accommodates a toner to be used in a developing process performed in the image forming apparatus;

a toner amount detector which detects an amount of toner in the developer housing;

a toner cartridge which is detachably mounted in the image forming apparatus, the toner cartridge being capable of accommodating the toner to be supplied to the developer housing depending upon an amount of toner accommodated in the developer housing;

an empty detector which detects that the toner cartridge is in a toner empty condition when the amount of toner detected by the toner amount detector is less than a predetermined amount;

a toner supply which supplies the toner from the toner cartridge to the developer housing when the amount of toner in the developer housing is less than the predetermined amount;

an empty memory which memorizes that the toner empty detector detects the empty condition;

a prohibition element which prohibits an image forming operation when the toner empty condition is detected by the empty detector;

a determination element which, when said image forming apparatus is disabled due to a cause rather than the detection of the toner empty condition, determines whether a recovery operation is a first recovery operation or a second recovery operation, said first recovery operation being associated with a mounting/dismounting of the toner cartridge performed from when the image forming apparatus is disabled until when the recovery operation begins and said second recovery operation being not associated with the mounting/dismounting of the toner cartridge performed from when the image forming apparatus is disabled until when the recovery operation begins; and a toner supply control which controls the toner supply operation when the recovery operation is performed on condition that the empty memory memorizes that the toner empty detector detects the empty condition, wherein, when the recovery operation is the first recovery operation, the toner supply control allows the toner to be supplied into the developer housing and, when the recovery operation is the second recovery operation, the toner supply control prohibits the toner from being supplied into developer housing.

3. The image forming apparatus according to claim 2, wherein the first recovery operation includes turning on a main power supply and closing a front door of the image forming apparatus, and the second recovery operation includes turning on a auxiliary power supply and clearing a power saving condition.

4. The image forming apparatus according to claim 2, further comprising:

a power control which controls a power supply to at least one or every electric part of the image forming apparatus;

a return information acquisition unit which acquires the information of the recovery operation based on a signal transmitted from the power control, wherein the determination element determines whether the recovery operation is the first recovery operation or the second recovery operation based on the information acquired by the return information acquisition unit.

5. The image forming apparatus of claim 2, wherein the developer housing comprises a two component developer made of the toner and a carrier, a toner amount detection unit detects a ratio (M/N) of a toner amount (M) to a carrier amount (N), and the empty detector detects that the toner cartridge is in the toner empty condition when it is detected that the ratio (M/N) is less than a predetermined amount by the toner amount detector.

6. An image forming apparatus, comprising:

a developer housing which accommodates a toner to be used in a developing process performed in the image forming apparatus;

a toner amount detector which detects an amount of toner in the developer housing;

a toner cartridge which is detachably mounted in the image forming apparatus, the toner cartridge being capable of accommodating the toner to be supplied to the developer housing depending upon an amount of toner accommodated in the developer, the toner cartridge including a cartridge memory which memorizes an identification information of the toner cartridge;

an identification information acquisition element which acquires the identification information from the cartridge memory of the toner cartridge mounted on the image forming apparatus;

an identification information memory which memorizes the identification information acquired by the identification information acquisition element;

an identification determination element which determines whether the identification information of the cartridge mounted on the image forming apparatus coincides with that memorized in the identification information memory;

an empty detector which detects that the toner cartridge is in a toner empty condition when the amount of toner detected by the toner amount detector is less than a predetermined amount;

a toner supply which supplies the toner from the toner cartridge to the developer housing when the amount of toner in the developer housing is less than the predetermined amount;

an empty memory which memorizes that the toner empty detector detects the empty condition;

a prohibition element which prohibits an image forming operation when the toner empty condition is detected by the empty detector;

a determination element which, when said image forming apparatus is disabled due to a cause rather than the detection of the toner empty condition, determines whether a recovery operation for enabling the image forming apparatus is a first recovery operation or a second recovery operation, said first recovery operation being associated with a mounting/dismounting of the toner cartridge performed from when the image forming apparatus is disabled until when the recovery operation begins and said second recovery operation being not associated with the mounting/dismounting of the toner cartridge performed from when the image forming apparatus is disabled until when the recovery operation begins; and a toner supply control which controls the toner supply operation when the recovery operation is performed on condition that the empty memory memorizes that the toner empty detector detects the empty condition, wherein, when the recovery operation is the first recovery operation, the toner supply control allows the toner supply to supply the toner into the developer housing and, when the recovery operation is the second recovery operation, the toner supply control allows the toner to be supplied into the developer housing if the identification determination element determines that the identification information of the cartridge mounted on the image forming apparatus differs from that memorized in the identification information memory, the toner supply control prohibits the toner from being supplied into the developer housing if the identification determination element determines that the identification information of the cartridge mounted on the image forming apparatus coincides with that memorized in the identification information memory.

7. An image forming method, comprising:

supplying a toner from a toner cartridge to a developer housing based on the consumption of the toner in the developer housing;

detecting whether the toner cartridge is in a toner empty condition by detecting whether a toner amount in the developer housing is less than a predetermined amount;

memorizing a fact that the toner empty condition has been detected;

prohibiting an image forming operation when the toner empty condition has been detected;

performing a recovery operation, after the image forming operation is disabled by a cause other than the toner empty condition, to clear the cause;

determining whether the recovery operation is a first recovery operation or a second recovery operation, said first recovery operation being associated with a mounting/dismounting of the toner cartridge performed from when an image forming apparatus is disabled until when the recovery operation begins and said second recovery operation being not associated with the mounting/dismounting of the toner cartridge performed from when the image forming apparatus is disabled until when the recovery operation begins; and controlling the toner supply operation which supplied the toner from the toner cartridge to the developer housing in order to recover the toner amount after determining the recovery operation is the first or second recovery operation when the recovery operation is performed under the condition that the toner empty condition has been detected, wherein, when the recovery operation is the first recovery operation, allowing the toner to be supplied into the developer housing and, when the recovery operation is the second recovery operation, prohibiting the toner from being supplied into developer housing.

8. The image forming method according to claim 7, wherein the first recovery operation includes turning on a main power supply and closing a front door of the image forming apparatus, and the second recovery operation includes turning on a auxiliary power supply and clearing a power saving condition.

9. An image forming method, comprising:

memorizing an identification information of a toner cartridge mounted on an image forming apparatus;

supplying a toner from the toner cartridge to a developer housing based on a consumption of the toner in the developer housing;

detecting whether the toner cartridge is in a toner empty condition by detecting whether a toner amount in the developer housing is less than a predetermined amount;

memorizing a fact that the toner empty condition has been detected after the toner empty condition has been detected;

prohibiting an image forming operation after the toner empty condition has been detected;

performing a recovery operation, after the image forming operation is disabled by a cause other than the toner empty condition, to clear the cause;

determining whether the recovery operation is a first recovery operation or a second recovery operation, said first recovery operation being associated with a mounting/dismounting of the toner cartridge performed from when the image forming apparatus is disabled until when the recovery operation begins and said second recovery operation being not associated with the mounting/dismounting of the toner cartridge performed from when the image forming apparatus is disabled until when the recovery operation begins; and determining whether the identification information of the toner cartridge mounted on the image forming apparatus coincides with the identification information memorized at the step of memorizing the identification information after the step of performing the recovery operation; and controlling the toner supply operation which supplied the toner from the toner cartridge to the developer housing in order to recover the toner amount after determining the recovery operation is the first or second recovery operation when the recovery operation is performed under the condition that the toner empty condition has been detected, wherein, when the recovery operation is the first recovery operation, allowing the toner to be supplied into the developer housing and, when the recovery operation is the second recovery operation, allowing the toner to be supplied into the developer housing if the identification information of the cartridge mounted on the image forming apparatus differs from the memorized identification information, while prohibiting the toner from being supplied into the developer housing if the identification information of the cartridge mounted on the image forming apparatus coincides with the memorized identification information.

* * * * *

UNITED STATES PATENT AND TRADEMARK OFFICE

CERTIFICATE OF CORRECTION

PATENT NO. : 7,949,264 B2
APPLICATION NO. : 12/173359
DATED : May 24, 2011
INVENTOR(S) : Hideo Mae et al.

It is certified that error appears in the above-identified patent and that said Letters Patent is hereby corrected as shown below:

Claims:

Claim 5, Col. 14, Line 6: after “amount” change “detection unit” to -- detector --

Signed and Sealed this
Sixteenth Day of August, 2011

David J. Kappos

David J. Kappos
*Director of the United States Patent and Trademark Office*